US012533555B2

(12) United States Patent
Sajima et al.

(10) Patent No.: US 12,533,555 B2
(45) Date of Patent: Jan. 27, 2026

(54) GOLF BALL HAVING MARK

(71) Applicant: SUMITOMO RUBBER INDUSTRIES, LTD., Hyogo (JP)

(72) Inventors: Takahiro Sajima, Hyogo (JP); Hidetaka Inoue, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 513 days.

(21) Appl. No.: 17/838,391

(22) Filed: Jun. 13, 2022

(65) Prior Publication Data

US 2022/0409961 A1 Dec. 29, 2022

(30) Foreign Application Priority Data

Jun. 28, 2021 (JP) ..... 2021-106394

(51) Int. Cl.
*A63B 37/00* (2006.01)
*A63B 69/36* (2006.01)

(52) U.S. Cl.
CPC ..... *A63B 37/0022* (2013.01); *A63B 69/3617* (2013.01)

(58) Field of Classification Search
CPC ..... A63B 37/0022
USPC ..... 473/407
See application file for complete search history.

(56) References Cited

U.S. PATENT DOCUMENTS 676,506 A * 6/1901 Knight et al. ..... A63B 43/008 D21/708
3,753,565 A * 8/1973 Baker ..... A63B 69/3655 473/378
4,209,172 A * 6/1980 Yamamoto ..... A63B 69/3685 473/200
4,706,958 A * 11/1987 Inoue ..... A63B 37/0022 473/378
5,067,719 A * 11/1991 Mook ..... A63B 69/3655 473/200
5,564,707 A * 10/1996 Dinh ..... A63B 45/02 473/270
5,713,799 A * 2/1998 Balmat ..... A63B 37/0022 473/200
D414,229 S * 9/1999 Sohn ..... D21/709
D429,510 S * 8/2000 Sullivan ..... D21/709
6,394,916 B1 * 5/2002 Doucettperry ..... A63B 57/207 473/285
D458,978 S * 6/2002 Lombardi ..... D21/709
6,409,610 B1 * 6/2002 Ahn ..... A63B 53/0487 473/251
6,422,949 B1 * 7/2002 Byrne ..... A63B 69/3688 473/200

(Continued)

FOREIGN PATENT DOCUMENTS

JP 2008-22940 2/2008
JP 2018-38575 3/2018

*Primary Examiner* — Eugene L Kim
*Assistant Examiner* — Matthew B Stanczak
(74) *Attorney, Agent, or Firm* — Greenblum & Bernstein, P.L.C.

(57) ABSTRACT

A golf ball includes an assist mark 10 and a guide mark. The assist mark is straight in plan. The guide mark is distorted in plan. The guide mark is in the shape of an arrow as a whole. The guide mark looks straight to a player swinging a golf club. The player moves the head of the golf club along the direction of the guide mark.

16 Claims, 14 Drawing Sheets

(56) References Cited

U.S. PATENT DOCUMENTS

| | | | | |
|---|---|---|---|---|
| 6,551,195 | B2 * | 4/2003 | Byrne | A63B 69/3688 473/200 |
| 6,752,725 | B2 * | 6/2004 | Kim | A63B 45/02 473/280 |
| D501,900 | S * | 2/2005 | Gammon, Jr. | D21/708 |
| D502,971 | S * | 3/2005 | Walsh | D21/708 |
| D506,235 | S * | 6/2005 | Kriews | D21/709 |
| D523,100 | S * | 6/2006 | Sano | D21/708 |
| D524,884 | S * | 7/2006 | Sano | D21/708 |
| D525,669 | S * | 7/2006 | Chute | D21/708 |
| 7,691,005 | B2 * | 4/2010 | Mitsuba | A63B 37/0022 D21/708 |
| 8,721,468 | B1 * | 5/2014 | Barrett | A63B 69/3688 473/200 |
| D924,344 | S * | 7/2021 | Bartels | D21/708 |
| 11,090,529 | B2 * | 8/2021 | Barrett | A63B 37/0022 |
| D931,390 | S * | 9/2021 | Bartels | D21/708 |
| D933,145 | S * | 10/2021 | Bartels | D21/708 |
| D952,779 | S * | 5/2022 | Kim | D21/709 |
| 11,426,645 | B2 * | 8/2022 | Irvin | A63B 53/0487 |
| 11,717,728 | B1 * | 8/2023 | Engle | B41N 1/00 473/378 |
| D1,009,190 | S * | 12/2023 | Veitch | D21/708 |
| 2002/0042304 | A1 * | 4/2002 | Delaplane | A63B 57/10 473/278 |
| 2002/0086741 | A1 * | 7/2002 | Newcomb | A63B 43/008 473/351 |
| 2008/0020865 | A1 * | 1/2008 | Mitsuba | A63B 37/0003 473/378 |
| 2011/0039638 | A1 | 2/2011 | Koleoglou | |
| 2015/0246265 | A1 | 9/2015 | Koleoglou | |
| 2023/0095376 | A1 * | 3/2023 | Madson | A63B 37/0022 473/199 |
| 2023/0249034 | A1 * | 8/2023 | Hogge | A63B 43/008 473/353 |

* cited by examiner

GOLF BALL HAVING MARK

CROSS-REFERENCE TO RELATED APPLICATION

This application claims priority on and the benefit of Patent Application No. 2021-106394 filed in JAPAN on Jun. 28, 2021. The entire disclosures of this Japanese Patent Application are hereby incorporated by reference.

BACKGROUND OF THE INVENTION

Field of the Invention

The present specification discloses a golf ball having an improved mark.

Description of the Related Art

Golf balls are printed with marks. The marks include literal marks, graphic marks, and marks combining letters and graphics. Typically, golf balls are printed with marks representing the brands of the balls. Such a mark representing a brand is commonly referred to as a main mark. Some golf balls have side marks in addition to main marks. Players identify the brands of golf balls with the aid of main or side marks.

In some cases, a golf ball is printed with a mark specific to the user. Such a mark is commonly referred to as "own name mark". Specific examples of the own name mark include user names, company names, company emblems, and catchphrases. During a round of play, the player can recognize their own golf ball based on the own name. The own name can prevent the player from hitting a wrong ball. Japanese Laid-Open Patent Application Publication No. 2018-038575 discloses a golf ball having a mark.

Japanese Laid-Open Patent Application Publication No. 2008-022940 discloses a golf ball having a so-called guide mark. When setting the golf ball, the player aligns the direction of the guide mark with the target direction. The player adjusts the swing trajectory while being guided by the guide mark.

Common guide marks are straight. Golf balls are spherical. Thus, a guide mark that is straight in plan is perceived by the player to be curved when the player is taking a swing. This guide mark does not contribute much to the adjustment of swing trajectory.

The present applicant aims to provide a golf ball that allows for easy adjustment of swing trajectory.

SUMMARY OF THE INVENTION

A preferred golf ball includes a guide mark. The guide mark is shaped such that the guide mark is distorted in plan and that when a player hits the golf ball with a golf club, the guide mark is perceived by the player to be undistorted in a sight line view of the player. The player who hits the golf ball can easily adjust the swing trajectory.

DESCRIPTION OF THE PREFERRED EMBODIMENTS

The following will describe in detail preferred embodiments with appropriate reference to the drawings.

Figure 1:
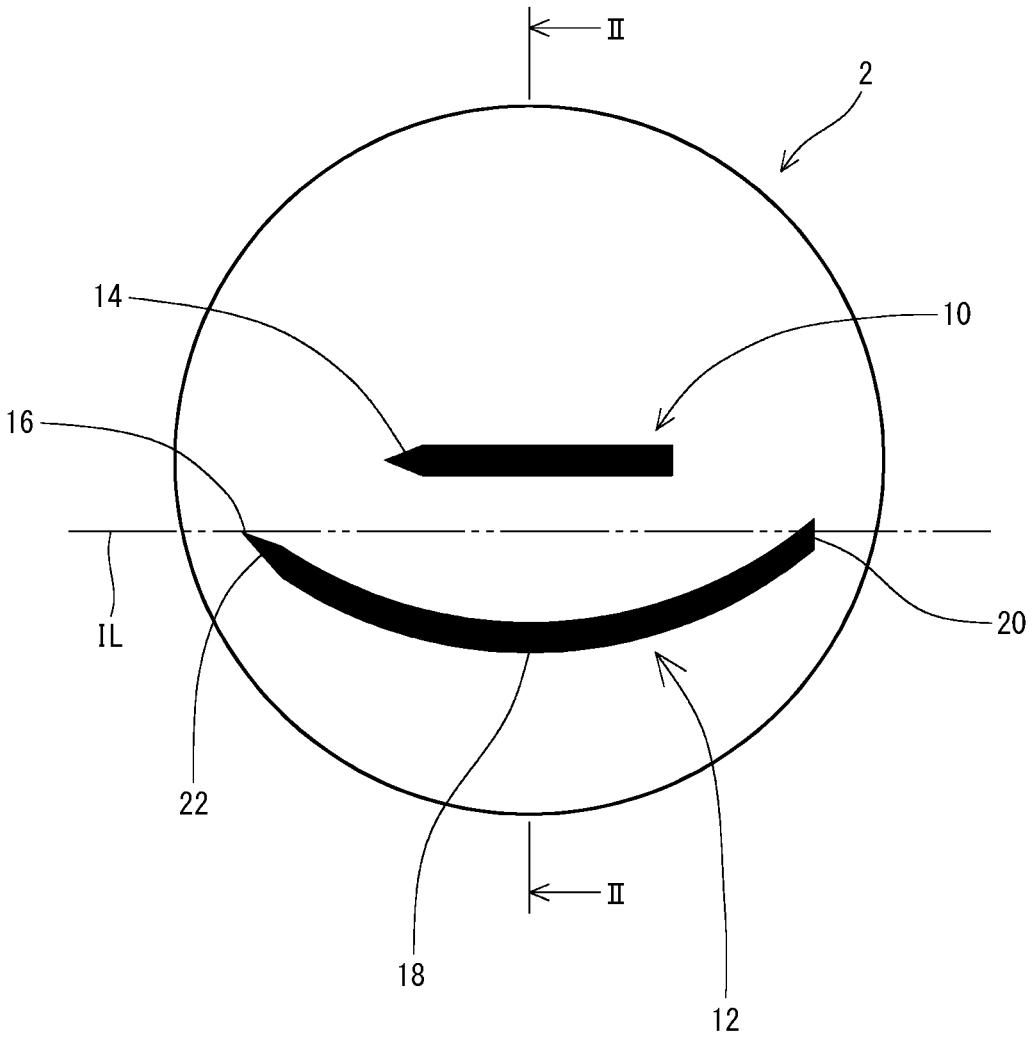
FIG. 1 is a plan view showing a golf ball according to one embodiment.
Figure 2:
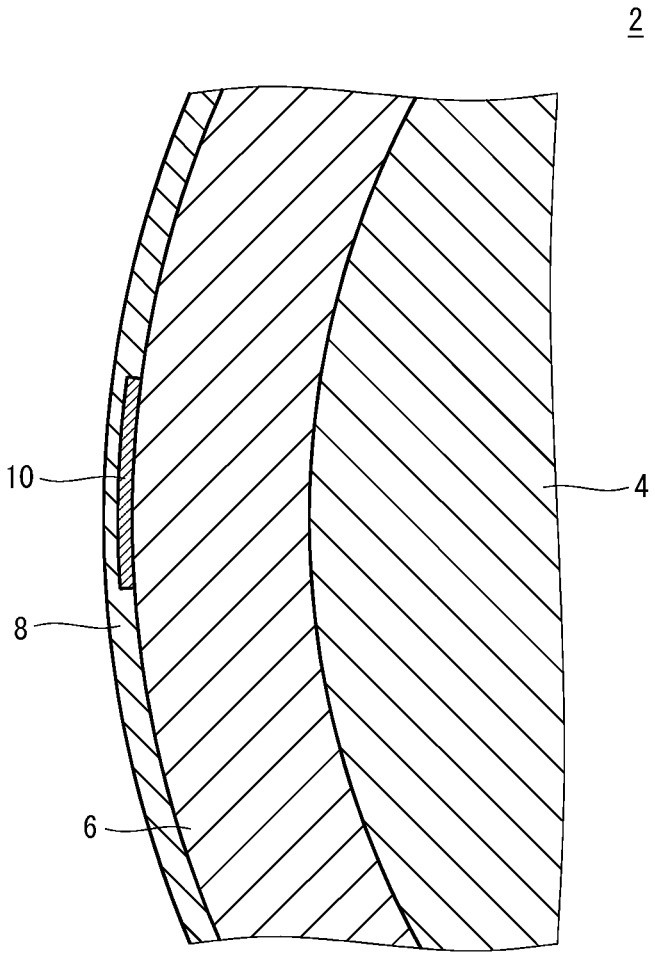
FIG. 2 is an enlarged view showing a part of a cross-section taken along the line II-II of FIG. 1.

A golf ball 2 shown in FIGS. 1 and 2 includes a core 4, a cover 6, a paint layer 8, an assist mark 10, and a guide mark 12. The core 4 is spherical. The material of the core 4 is a crosslinked rubber composition. The core 4 may include two or more layers. The cover 6 covers the core 4. The material of the cover 6 is a resin composition. The cover 6 may include two or more layers. The paint layer 8 covers the cover 6. The material of the paint layer 8 is a resin composition. In the present embodiment, the paint layer 8 is transparent. The golf ball 2 may include an intermediate layer. The intermediate layer is located between the core 4 and cover 6. Although not shown, the golf ball 2 has a large number of dimples on its surface. The diameter of the golf ball 2 is not less than 40 mm and not greater than 45 mm. The weight of the golf ball 2 is not less than 40 g and not greater than 50 g.

As shown in FIG. 2, the assist mark 10 is interposed between the cover 6 and paint layer 8. The material of the assist mark 10 is a resin composition. The resin composition contains a base resin and a coloring agent. The assist mark 10 is visible through the paint layer 8 since the paint layer 8 is transparent as stated above. The assist mark 10 may be formed on the paint layer 8.

Although not shown, the guide mark 12 is also interposed between the cover 6 and paint layer 8 like the assist mark 10. The material of the guide mark 12 is a resin composition. The resin composition contains a base resin and a coloring agent. The guide mark 12 is visible through the paint layer 8 since the paint layer 8 is transparent as stated above. The guide mark 12 may be formed on the paint layer 8.

The golf ball 2 may have a main mark. The main mark represents the brand of the golf ball 2. The golf ball 2 may have a side mark. The side mark also represents the brand of the golf ball 2.

FIG. 1 shows the golf ball 2 placed on a tee in a teeing ground. FIG. 1 is a plan view of the golf ball 2. In other words, the golf ball 2 as viewed from above in the vertical direction is shown in FIG. 1. The leftward direction in FIG. 1 is the target direction. The player desires to launch the golf ball 2 in the target direction.

As is clear from FIG. 1, the assist mark 10 is straight in plan. The assist mark 10 has a tapered head 14. In other words, the assist mark 10 is in the shape of an arrow as a whole. The direction of the assist mark 10 (the direction of the arrow) is the leftward direction in FIG. 1. In other words, the direction of the assist mark 10 coincides with the target direction.

As is clear from FIG. 1, the guide mark 12 is distorted in plan. In the present embodiment, the guide mark 12 extends along a great circle of the golf ball 2. The great circle is the largest of circles that can be depicted on the spherical surface of the golf ball 2. The diameter of the great circle is equal to the diameter of the sphere of the golf ball 2. The golf ball 2 has a huge number of great circles. The guide mark 12 is generally arc-shaped in plan since the guide mark 12 extends along one of the great circles. The guide mark 12 has a front end 16, a middle point 18, and a back end 20. The guide mark 12 has a tapered head 22. In other words, the guide mark 12 is in the shape of an arrow as a whole. Thus, the front and back ends 16 and 20 of the guide mark 12 are distinguishable from each other. The guide mark 12 is directional. The golf ball 2 may have a non-directional guide mark.

In FIG. 1, the dashed double-dotted line IL passes through the front and back ends 16 and 20. The dashed double-dotted line IL extends in the left-right direction. In other words, the direction of the dashed double-dotted line IL coincides with the target direction. The distance between the front end 16 and middle point 18 in the left-right direction is equal to the distance between the middle point 18 and back end 20 in the left-right direction.

Figure 3:
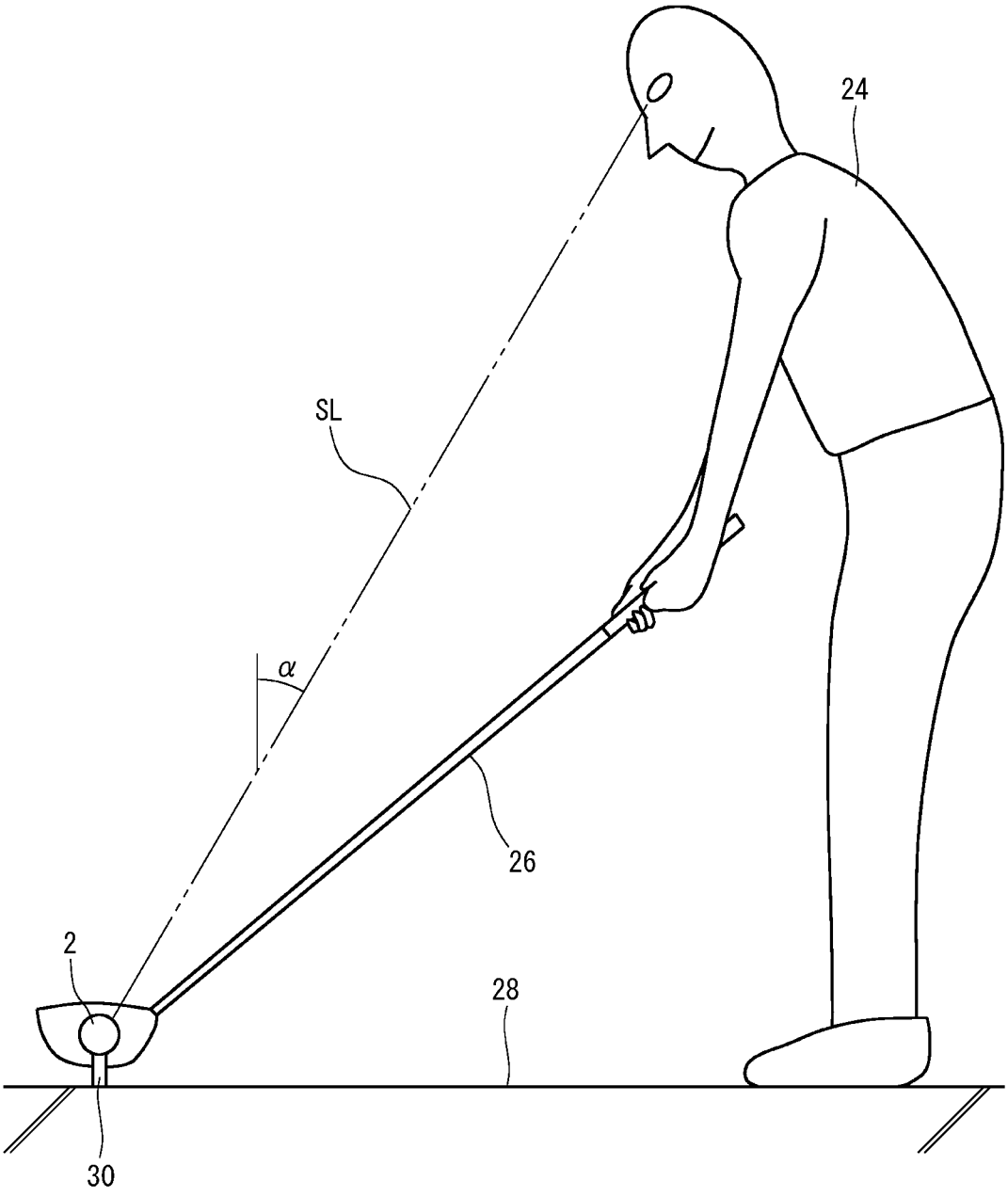
FIG. 3 is a left side view showing the golf ball of FIG. 1 along with a player and a golf club.

FIG. 3 is a left side view showing the golf ball 2 of FIG. 1 along with a player 24 and a golf club 26. FIG. 3 further shows a ground 28 and a tee 30. The tee 30 rises from the ground 28. The golf ball 2 rests on the tee 30. The player 24 grips the golf club 26. In the present embodiment, the golf club 26 is a driver (W #1). The dashed double-dotted line SL in FIG. 3 represents the sight line of the player 24. The sight line SL connects the eyes of the player 24 to the center of the golf ball 2. The symbol $\alpha$ in FIG. 3 represents the angle of the sight line SL with respect to the vertical direction.

Figure 4:
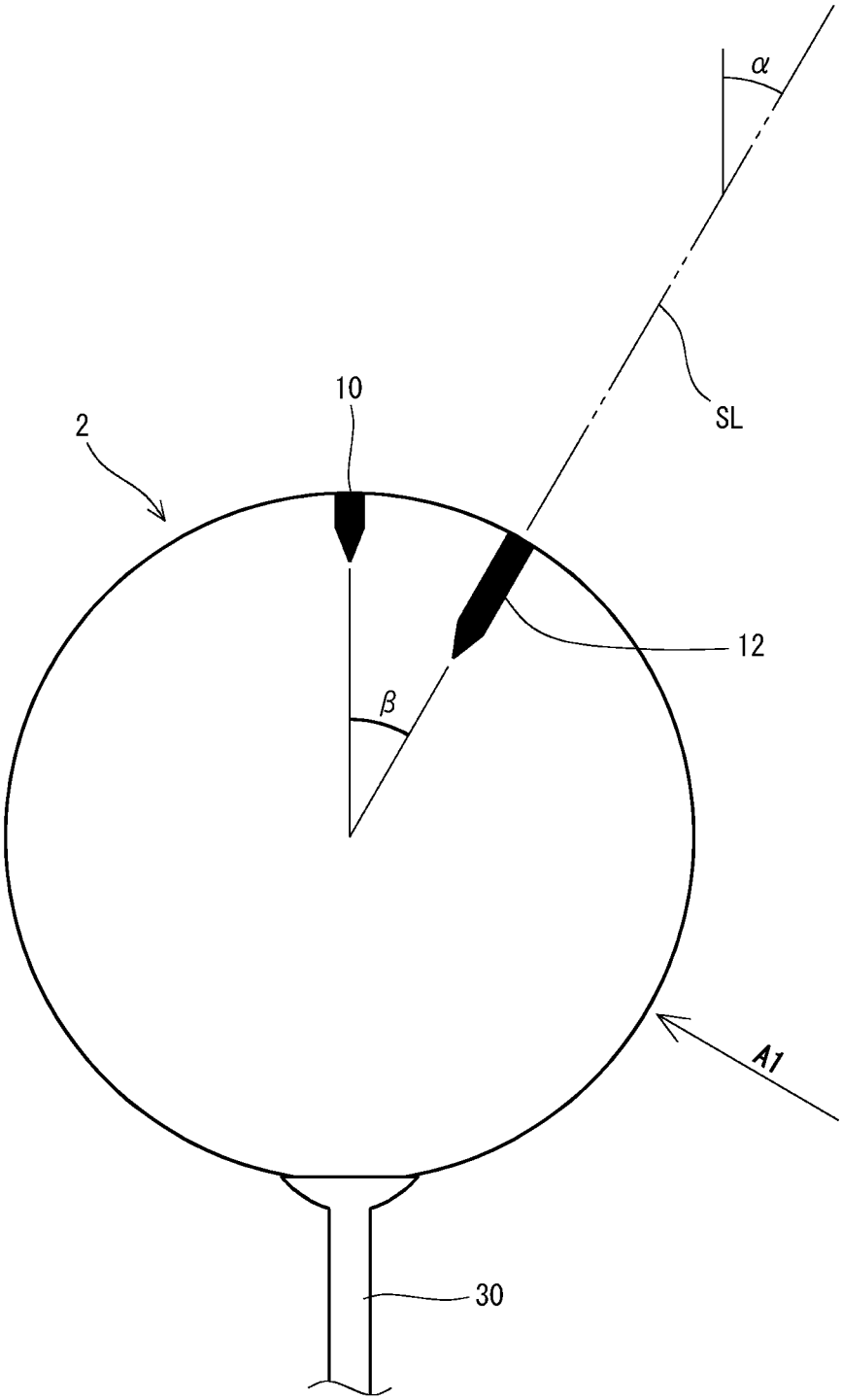
FIG. 4 is an enlarged view showing the golf ball of FIG. 3 along with a tee.

FIG. 4 is an enlarged view showing the golf ball 2 of FIG. 3 along with the tee 30. As is clear from FIG. 4, the sight line SL passes through the guide mark 12.

Figure 5:
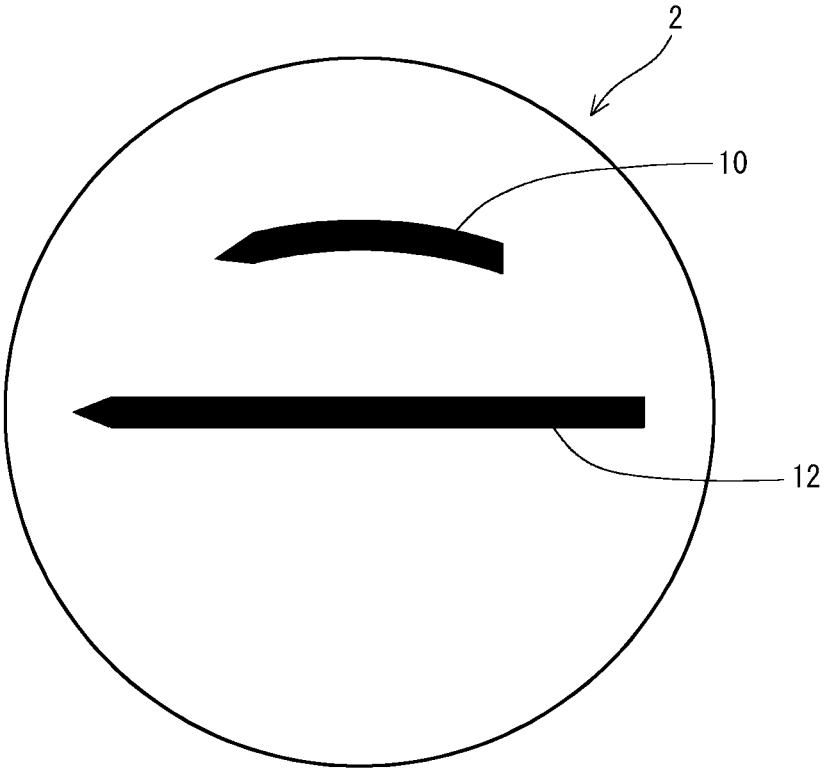
FIG. 5 shows the golf ball of FIG. 1 in a sight line view.

FIG. 5 shows the golf ball 2 of FIG. 1 in a sight line view. FIG. 5 is the view of the player 24 swinging the golf club 26. In FIG. 5, the guide mark 12 is straight. In other words, the guide mark 12 is perceived by the player 24 to be undistorted. Anamorphosis is utilized for the guide mark 12.

Upon arriving at the teeing ground 28, the player 24 puts the tee 30 into the ground 28. The player 24 places the golf ball 2 on the tee 30. The player 24 adjusts the attitude of the golf ball 2 on the tee 30. Specifically, the player 24 adjusts the attitude of the golf ball 2 such that the golf ball 2 meets the following conditions (1) and (2).

(1) When the golf ball 2 is assumed to be a globe, the assist mark 10 is located at the north pole of the globe.
(2) The arrow of the assist mark 10 points in the target direction.

The assist mark 10 assists the player 24 to properly set the golf ball 2. FIGS. 4 and 5 show the golf ball 2 viewed after the setting. This setting may be done on the ground rather than on the tee 30.

After the setting, the player 24 swings the golf club 26. During the swing, the player 24 views the guide mark 12. The player 24 moves the club head along the direction of the guide mark 12. In other words, the player 24 adjusts the swing trajectory with the aid of the guide mark 12. The golf ball 2 hit by the club head is launched in the target direction. The guide mark 12 assists the player 24 to achieve a proper swing. The golf ball 2 having the guide mark 12 can contribute to a good score of the player 24.

In FIG. 4, the symbol $\beta$ represents the central angle of the guide mark 12 with respect to the vertical direction. The central angle $\beta$ is measured at the middle point 18 of the guide mark 12. As shown in FIG. 4, the central angle $\beta$ is the same as the angle $\alpha$ of the sight line SL of the player 24. Thus, the player 24 can view the guide mark 12 in front of the player 24. Since the guide mark 12 extends along a great circle as previously stated, the player 24 perceives the guide mark 12 to be straight. The central angle $\beta$ may be somewhat different from the angle $\alpha$. The central angle $\beta$ is preferably not less than 5° and not greater than 40°.

The angle $\alpha$ varies depending on the build and posture of the player 24 and the specifications of the golf club 26. The golf ball 2 for which the central angle $\beta$ is substantially the same as the angle $\alpha$ is selected by the player 24.

If the player 24 assumes an improper posture at address, the guide mark 12 looks distorted to the player 24 despite selection of the golf ball 2 that should cause the player 24 to perceive the guide mark 12 to be straight. For example, when the player 24 stands too close to the golf ball 2, the guide mark 12 appears to be a downwardly convex curve. When the player 24 bends their knees too much, the guide mark 12 appears to be an upwardly convex curve. The player 24 having perceived the guide mark 12 to be curved corrects the posture. The golf ball 2 can contribute to the player 24's learning of a proper swing.

Figure 6:
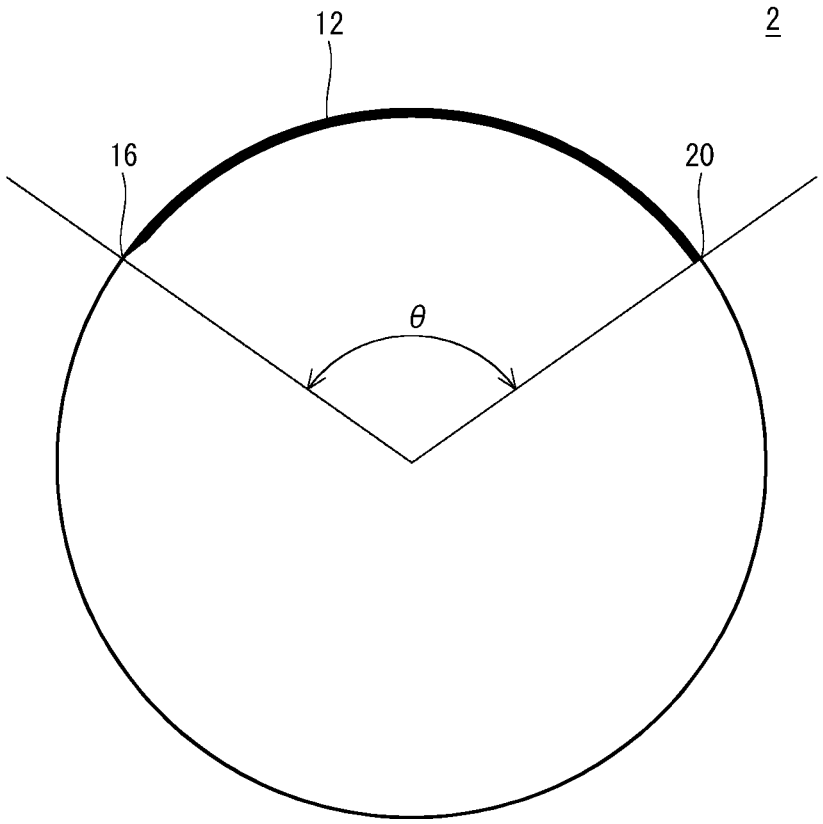
FIG. 6 shows the golf ball of FIG. 4 as viewed in the direction of an arrow.

FIG. 6 shows the golf ball 2 as viewed in the direction of the arrow A1 of FIG. 4. The arrow A1 is orthogonal to the sight line SL. FIG. 6 shows the front and back ends 16 and 20 of the guide mark 12. In FIG. 6, the symbol $\theta$ represents the central angle between the front and back ends 16 and 20. In order to assist the player 24 to achieve a proper swing, the central angle $\theta$ is preferably not less than 90°, more preferably not less than 110°, and particularly preferably not less than 120°. The upper limit of the central angle is 360°.

In putting, the angle $\alpha$ of the sight line of the player 24 is generally almost zero. In putting, the player 24 can hit the golf ball 2 in the target direction with assistance from the assist mark 10. The golf ball 2 may be devoid of the assist mark 10.

Figure 7:
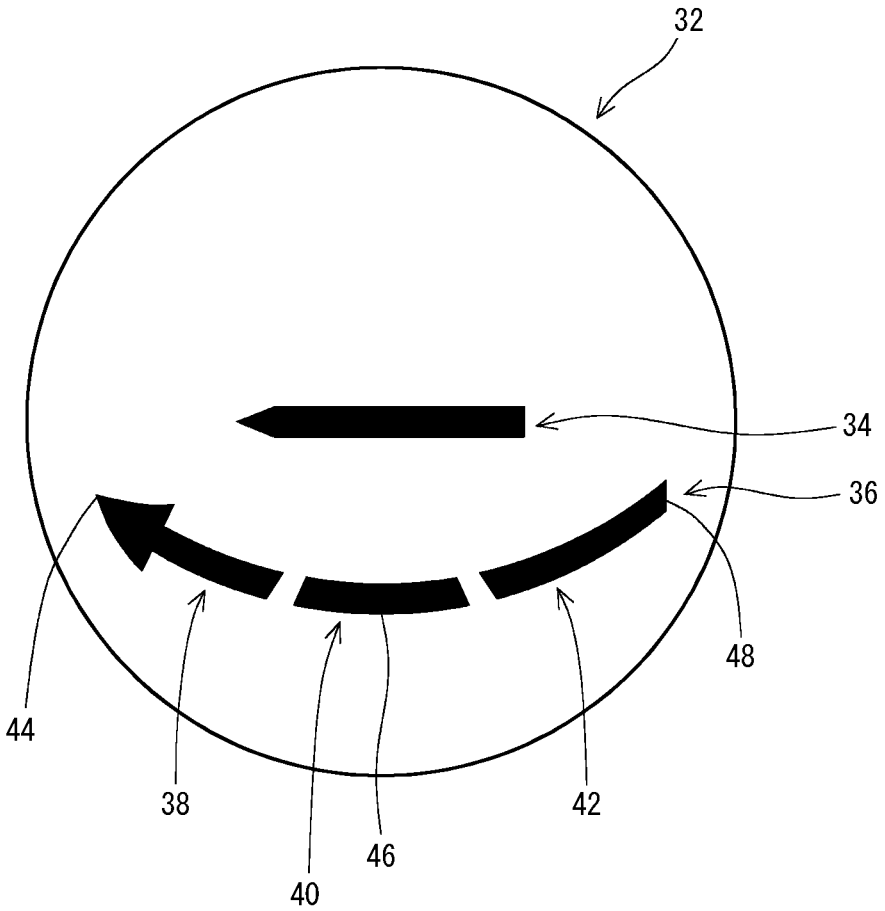
FIG. 7 is a plan view showing a golf ball according to another embodiment.

FIG. 7 is a plan view showing a golf ball 32 according to another embodiment. The golf ball 32 has an assist mark 34 and a guide mark 36. The specifications of the golf ball 32 other than the shape of the guide mark 36 are the same as those of the golf ball 2 shown in FIGS. 1 and 2.

The guide mark 36 includes a first curve 38, a second curve 40, and a third curve 42. The first curve 38 includes a front end 44. The second curve 40 includes a middle point 46. The third curve 42 includes a back end 48. The three curves are generally arc-shaped as a whole. The guide mark 36 is in the shape of an arrow as a whole. The guide mark 36 is directional.

The guide mark 36 can be perceived by the player to be undistorted when the player is taking a swing. Anamorphosis is utilized for the guide mark 36. The player moves the club head along the direction of the guide mark 36. The golf ball 32 hit by the club head is launched in the target direction. The guide mark 36 assists the player to achieve a proper swing. Additionally, the guide mark 36 can contribute to the player's learning of a proper swing. The central angle $\beta$ of the guide mark 36 with respect to the vertical direction (see FIG. 4) is preferably not less than 5° and not greater than 40°. The central angle θ between the front and back ends 44 and 48 of the guide mark 36 (see FIG. 6) is preferably not less than 90°, more preferably not less than 110°, and particularly preferably not less than 120°. The upper limit of the central angle θ is 360°.

Figure 8:
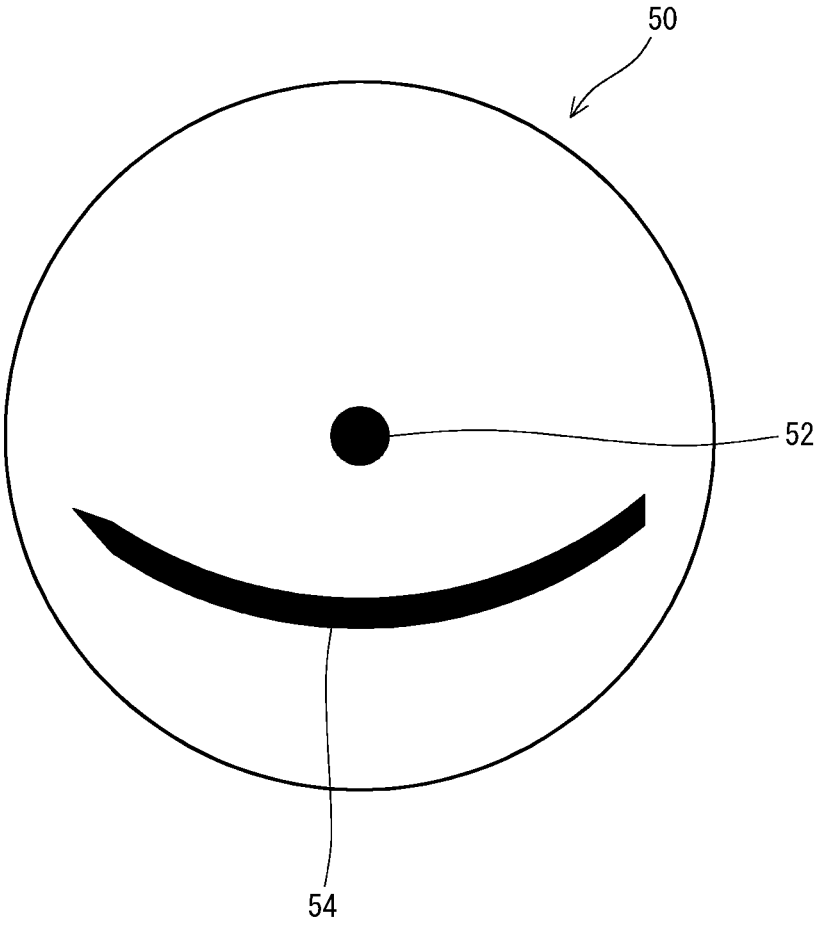
FIG. 8 is a plan view showing a golf ball according to yet another embodiment.

FIG. 8 is a plan view showing a golf ball 50 according to yet another embodiment. The golf ball 50 has an assist mark 52 and a guide mark 54. The specifications of the golf ball 50 other than the shape of the assist mark 52 are the same as those of the golf ball 2 shown in FIGS. 1 and 2.

The assist mark 52 is circular. The player adjusts the attitude of the golf ball 50 such that when the golf ball 50 is assumed to be a globe, the assist mark 52 is located at the north pole of the globe. Further, the player adjusts the attitude of the golf ball 50 such that the arrow of the guide mark 54 points in the target direction. The player then takes a swing while being guided by the guide mark 54. During the swing, the player perceives the guide mark 54 to be undistorted. The golf ball 50 assists the player to achieve a proper swing. Additionally, the golf ball 50 can contribute to the player's learning of a proper swing.

Figure 9:
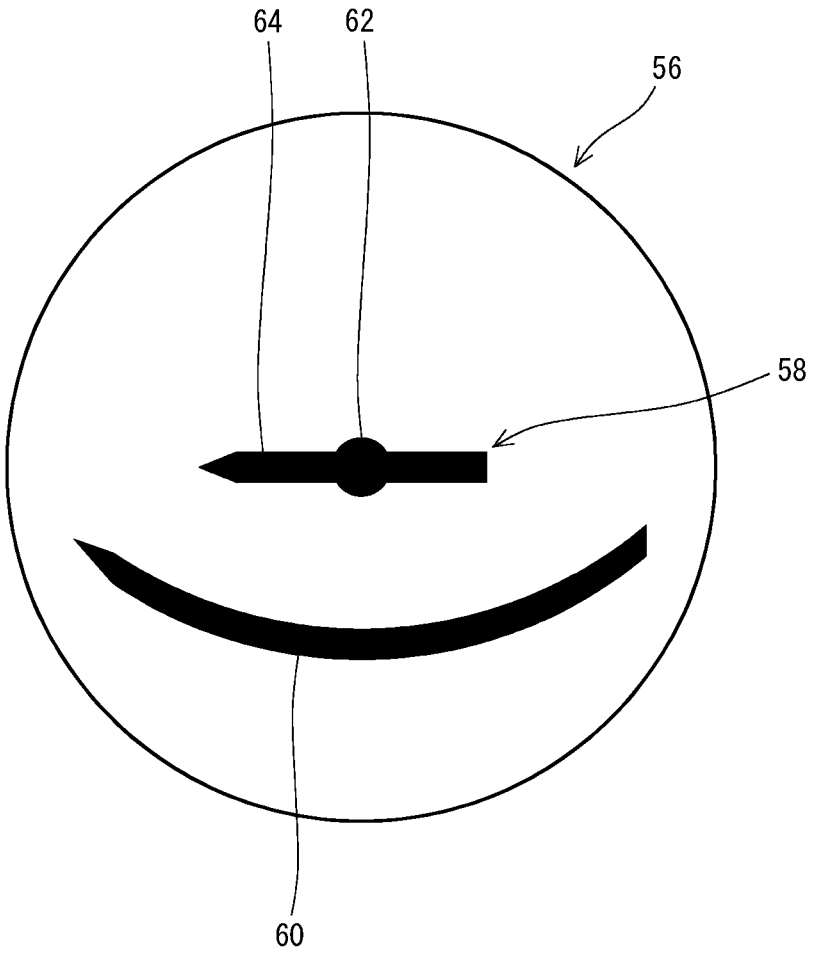
FIG. 9 is a plan view showing a golf ball according to yet another embodiment.

FIG. 9 is a plan view showing a golf ball 56 according to yet another embodiment. The golf ball 56 has an assist mark 58 and a guide mark 60. The specifications of the golf ball 56 other than the shape of the assist mark 58 are the same as those of the golf ball 2 shown in FIGS. 1 and 2.

The assist mark 58 includes a circle portion 62 and an arrow portion 64. The player adjusts the attitude of the golf ball 56 such that when the golf ball 56 is assumed to be a globe, the circle portion 62 is located at the north pole of the globe. Further, the player adjusts the attitude of the golf ball 56 such that the arrow portion 64 points in the target direction. The player then takes a swing while being guided by the guide mark 60. During the swing, the player perceives the guide mark 60 to be undistorted. The golf ball 56 assists the player to achieve a proper swing. Additionally, the golf ball 56 can contribute to the player's learning of a proper swing.

Figure 10:
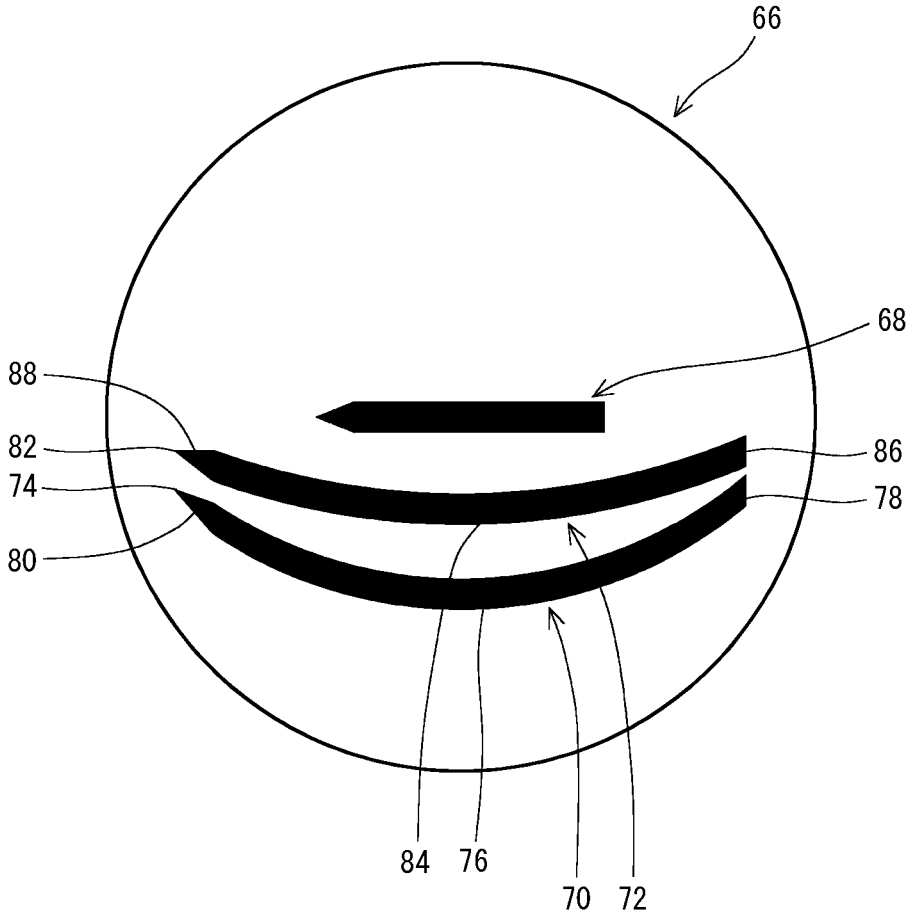
FIG. 10 is a plan view showing a golf ball according to yet another embodiment.
Figure 11:
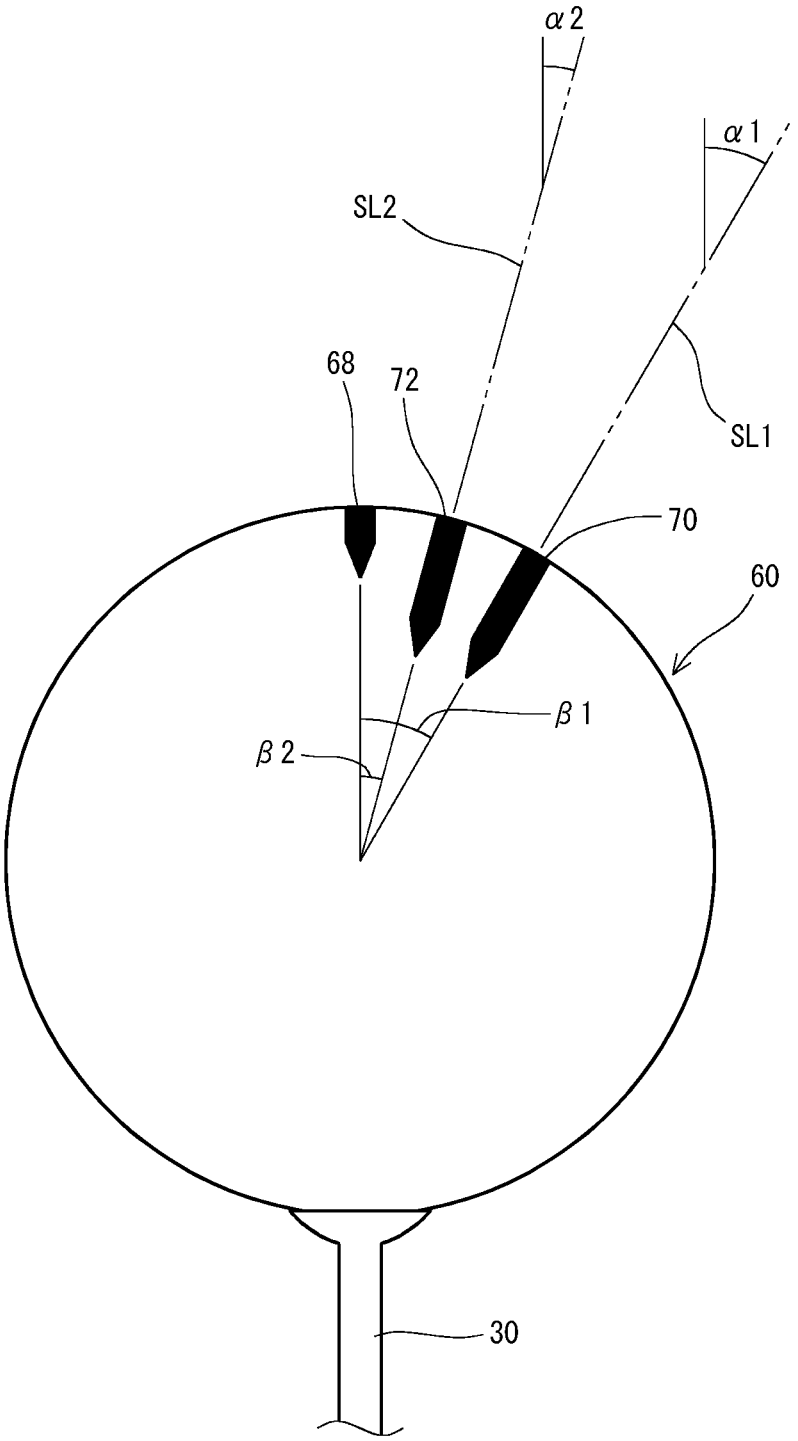
FIG. 11 is a left side view showing the golf ball of FIG. 10 along with a tee.

FIG. 10 is a plan view showing a golf ball 66 according to yet another embodiment, and FIG. 11 is a left side view of the golf ball 66. The golf ball 66 has an assist mark 68, a first guide mark 70, and a second guide mark 72. The specifications of the golf ball 66 other than the guide marks are the same as those of the golf ball 2 shown in FIGS. 1 and 2.

As is clear from FIG. 10, the first guide mark 70 is distorted in plan. In the present embodiment, the first guide mark 70 extends along a great circle of the golf ball 66. The first guide mark 70 is generally arc-shaped. The first guide mark 70 has a front end 74, a middle point 76, and a back end 78. The first guide mark 70 has a tapered head 80. The first guide mark 70 is directional.

The first guide mark 70 is perceived by the player to be straight (undistorted) when the player is taking a swing. Anamorphosis is utilized for the first guide mark 70. The player moves the club head along the direction of the first guide mark 70. The golf ball 66 hit by the club head is launched in the target direction. The first guide mark 70 assists the player to achieve a proper swing. Additionally, the first guide mark 70 can contribute to the player's learning of a proper swing. The central angle β1 of the first guide mark 70 with respect to the vertical direction (see FIG. 11) is preferably not less than 5° and not greater than 40°. The central angle θ1 between the front and back ends 74 and 78 of the first guide mark 70 is preferably not less than 90°, more preferably not less than 110°, and particularly preferably not less than 120°. The upper limit of the central angle θ1 is 360°.

The second guide mark 72 is distorted in plan. The degree of distortion of the second guide mark 72 is smaller than that of the first guide mark 70. In the present embodiment, the second guide mark 72 extends along a great circle different from the great circle along which the first guide mark 70 extends. The second guide mark 72 is generally arc-shaped. The second guide mark 72 has a front end 82, a middle point 84, and a back end 86. The second guide mark 72 has a tapered head 88. The second guide mark 72 is directional.

The second guide mark 72 is perceived by the player to be straight (undistorted) when the player is taking a swing. Anamorphosis is utilized for the second guide mark 72. The player moves the club head along the direction of the second guide mark 72. The golf ball 66 hit by the club head is launched in the target direction. The second guide mark 72 assists the player to achieve a proper swing. Additionally, the second guide mark 72 can contribute to the player's learning of a proper swing. The central angle β2 of the second guide mark 72 with respect to the vertical direction (see FIG. 11) is preferably not less than 5° and not greater than 40°. The central angle β2 is smaller than the central angle β1. The central angle θ2 between the front and back ends 82 and 86 of the second guide mark 72 is preferably not less than 90°, more preferably not less than 110°, and particularly preferably not less than 120°. The upper limit of the central angle θ2 is 360°.

Since the central angle β1 is large, the first guide mark 70 is suitable for a swing in which the angle α1 of the sight line SL1 is large. For example, the first guide mark 70 is suitable for a swing with a driver (W #1). From this viewpoint, the central angle β1 is particularly preferably not less than 200 and not greater than 35°.

Since the central angle β2 is small, the second guide mark 72 is suitable for a swing in which the angle α2 of the sight line SL2 is small. For example, the second guide mark 72 is suitable for a swing with an iron golf club. From this viewpoint, the central angle β2 is particularly preferably not less than 10° and not greater than 25°.

In light of utility in swings with various types of golf clubs, the difference (β1−β2) between the central angles β1 and β2 is preferably not less than 5°, more preferably not less than 10°, and particularly preferably not less than 13°. The difference (β1−β2) is preferably not greater than 25°. The golf ball 66 may have three or more guide marks differing in central angle β.

Figure 12:
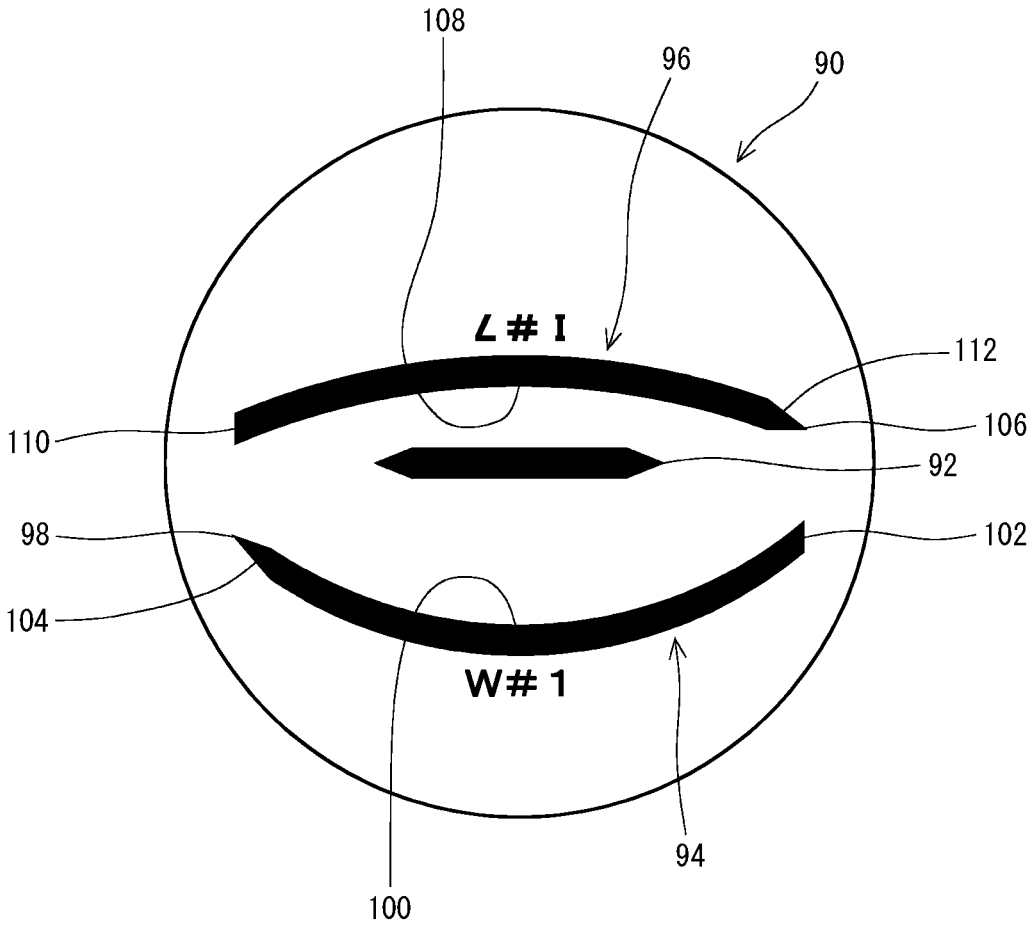
FIG. 12 is a plan view showing a golf ball according to yet another embodiment.
Figure 13:
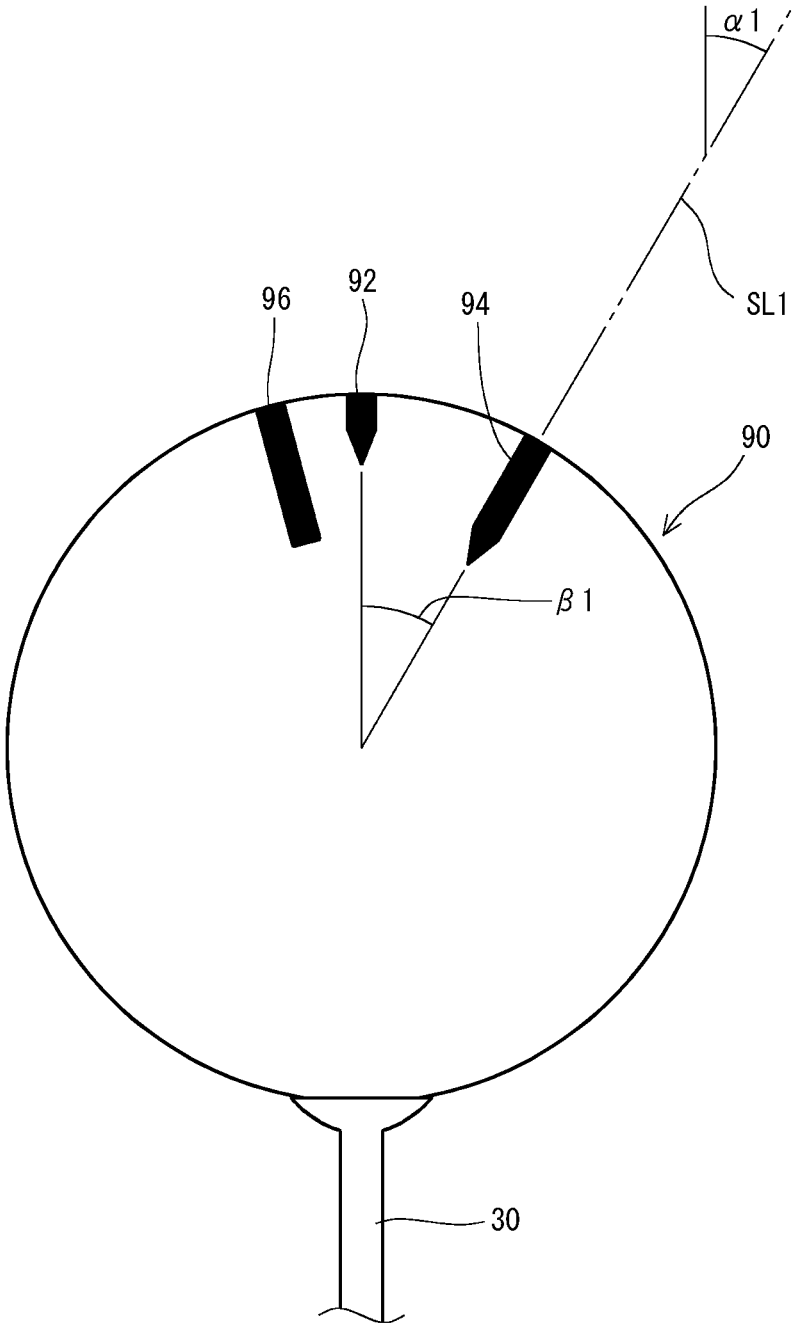
FIG. 13 is a left side view showing the golf ball of FIG. 12 along with a tee.
Figure 14:
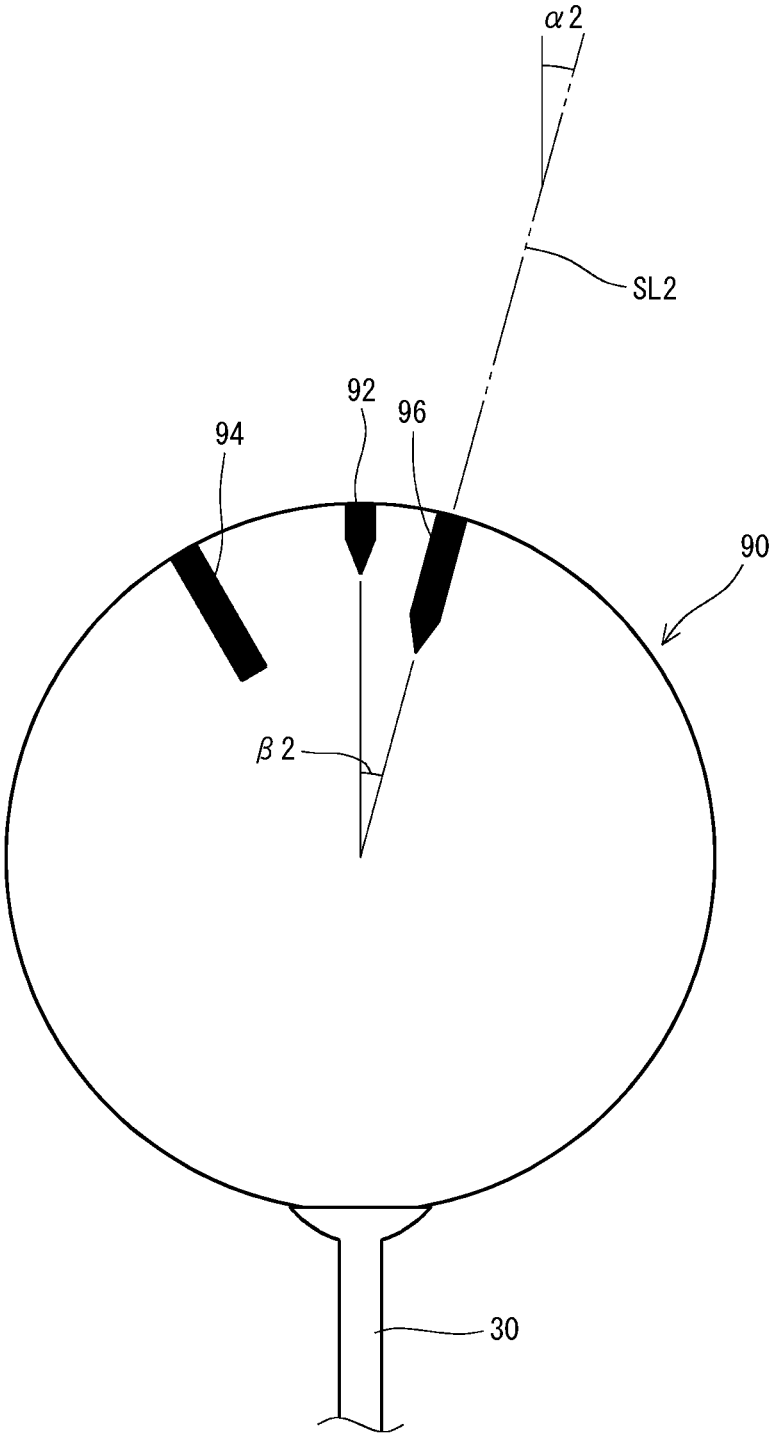
FIG. 14 is a right side view showing the golf ball of FIG. 12 along with a tee.

FIG. 12 is a plan view showing a golf ball 90 according to yet another embodiment, FIG. 13 is a left side view of the golf ball 90, and FIG. 14 is a right side view of the golf ball 90. The golf ball 90 has an assist mark 92, a first guide mark 94, and a second guide mark 96. The specifications of the golf ball 90 other than the guide marks are the same as those of the golf ball 2 shown in FIGS. 1 and 2.

As is clear from FIG. 12, the first guide mark 94 is distorted in plan. In the present embodiment, the first guide mark 94 extends along a great circle of the golf ball 90. The first guide mark 94 is generally arc-shaped. The first guide mark 94 has a front end 98, a middle point 100, and a back end 102. The first guide mark 94 has a tapered head 104. The first guide mark 94 is directional.

The first guide mark 94 is perceived by the player to be straight (undistorted) when the player is taking a swing. Anamorphosis is utilized for the first guide mark 94. The player moves the club head along the direction of the first guide mark 94. The golf ball 90 hit by the club head is launched in the target direction. The first guide mark 94 assists the player to achieve a proper swing. Additionally, the first guide mark 94 can contribute to the player's learning of a proper swing. The central angle β1 of the first guide mark 94 with respect to the vertical direction (see FIG. 13) is preferably not less than 5° and not greater than 40°. The central angle θ1 between the front and back ends 98 and 102 of the first guide mark 94 is preferably not less than 90°, more preferably not less than 110°, and particularly preferably not less than 120°. The upper limit of the central angle θ1 is 360°.

The second guide mark 96 is located across the assist mark 92 from the first guide mark 94. The second guide mark 96 is distorted in plan. The degree of distortion of the second guide mark 96 is smaller than that of the first guide mark 94. In the present embodiment, the second guide mark 96 extends along a great circle different from the great circle along which the first guide mark 94 extends. The second guide mark 96 is generally arc-shaped. The second guide mark 96 has a front end 106, a middle point 108, and a back end 110. The second guide mark 96 has a tapered head 112. The second guide mark 96 is directional. The direction of the second guide mark 96 is opposite to the direction of the first guide mark 94.

The second guide mark 96 is perceived by the player to be straight (undistorted) when the player is taking a swing. Anamorphosis is utilized for the second guide mark 96. The player moves the club head along the direction of the second guide mark 96. The golf ball 90 hit by the club head is launched in the target direction. The second guide mark 96 assists the player to achieve a proper swing. Additionally, the second guide mark 96 can contribute to the player's learning of a proper swing. The central angle β2 of the second guide mark 96 with respect to the vertical direction (see FIG. 14) is preferably not less than 5° and not greater than 40°. The central angle β2 is smaller than the central angle β1. The central angle θ2 between the front and back ends 106 and 110 of the second guide mark 96 is preferably not less than 90°, more preferably not less than 110°, and particularly preferably not less than 120°. The upper limit of the central angle θ2 is 360°.

Since the central angle β1 is large, the first guide mark 94 is suitable for a swing in which the angle α1 of the sight line is large. For example, the first guide mark 94 is suitable for a swing with a driver (W #1). From this viewpoint, the central angle β1 is particularly preferably not less than 200 and not greater than 35°. As shown in FIG. 12, the golf ball 90 has a letter string "W #1". This letter string is located near the first guide mark 94.

Since the central angle β2 is small, the second guide mark 96 is suitable for a swing in which the angle α2 of the sight line is small. For example, the second guide mark 96 is suitable for a swing with an iron golf club. From this viewpoint, the central angle β2 is particularly preferably not less than 10° and not greater than 25°. As shown in FIG. 12, the golf ball 90 has a letter string "I #7". This letter string is located near the second guide mark 96.

In light of utility in swings with various types of golf clubs, the difference (β1−β2) between the central angles β1 and β2 is preferably not less than 5°, more preferably not less than 10°, and particularly preferably not less than 13°. The difference (β1−β2) is preferably not greater than 25°. The golf ball 90 may have three or more guide marks differing in central angle S.

The letter string "W #1" allows the player to know the type and number of the golf club to be used. The player selects a golf ball with the letter string "W #1" prior to a shot with a driver (first golf club). Further, the player selects the first guide mark 94 by reference to the letter string "W #1". The player sets the golf ball 90 such that the arrow of the first guide mark 94 points in the target direction.

The letter string "I #7" allows the player to know the type and number of the golf club to be used. The player selects a golf ball with the letter string "I #7" prior to a shot with a seven iron club (second golf club). Further, the player selects the second guide mark 96 by reference to the letter string "I #7". The player sets the golf ball 90 such that the arrow of the second guide mark 96 points in the target direction. The orientation of the golf ball 90 in this case is opposite to that in the shot with the driver.

As shown in FIG. 12, the assist mark 92 is in the shape of a double-headed arrow. The assist mark 92 helps to adjust the attitude of the golf ball 90 prior to the shot with the driver (FIG. 13). Additionally, the assist mark 92 helps to adjust the attitude of the golf ball 90 prior to the shot with the iron (FIG. 14).

The golf ball may have another letter string to allow the player to know the type and number of the golf club to be used. Examples of the other letter string include "W #2", "W #3", "W #4", "W #5", "W #6", "W #7", "W #8", "W #9", "U #1", "U #2", "U #3", "U #4", "U #5", "U #6", "U #7", "U #8", "U #9", "I #1", "I #2", "I #3", "I #4", "I #5", "I #6", "I #8", "I #9", "PW", "AW", "SW", and "P". The golf ball may have a letter string representing the loft angle of the golf club to be used.

The following items are disclosures of preferred embodiments.

[Item 1]

A golf ball including a guide mark, wherein the guide mark is shaped such that the guide mark is distorted in plan and that when a player hits the golf ball with a golf club, the guide mark is perceived by the player to be undistorted in a sight line view of the player.

[Item 2]

The golf ball according to Item 1, wherein the guide mark is shaped such that the guide mark is curved in plan and straight in the sight line view.

[Item 3]

The golf ball according to Item 1 or 2, wherein a central angle β of the guide mark with respect to a vertical direction is not less than 5° and not greater than 40°.

[Item 4]

The golf ball according to any one of Items 1 to 3, wherein a central angle θ between front and back ends of the guide mark is not less than 90°.

[Item 5]

The golf ball according to any one of Items 1 to 4, wherein the guide mark is directional.

[Item 6]

The golf ball according to any one of Items 1 to 5, wherein the guide mark extends along a great circle of a sphere of the golf ball.

[Item 7]

The golf ball according to any one of Items 1 to 6, further including an assist mark indicating an attitude to be assumed by the golf ball when the golf ball is set by the player.

[Item 8]

A golf ball including a first guide mark and a second guide mark, wherein the first guide mark is shaped such that the first guide mark is distorted in plan and that when the player hits the golf ball with a first golf club, the first guide mark is perceived by the player to be undistorted in a first sight line view of the player, and the second guide mark is shaped such that the second guide mark is distorted in plan and that when the player hits the golf ball with a second golf club, the second guide mark is perceived by the player to be undistorted in a second sight line view of the player.

[Item 9]

The golf ball according to Item 8, wherein the first guide mark is shaped such that the first guide mark is curved in plan and straight in the first sight line view, and the second guide mark is shaped such that the second guide mark is curved in plan and straight in the second sight line view.

[Item 10]

The golf ball according to Item 8 or 9, wherein a central angle β1 of the first guide mark with respect to a vertical direction is not less than 5° and not greater than 40°, a central angle β2 of the second guide mark with respect to the vertical direction is not less than 5° and not greater than 40°, and the angle β1 is greater than the angle β2.

[Item 11]

The golf ball according to Item 10, wherein the angle β1 is not less than 200 and not greater than 35°, and the angle β2 is not less than 10° and not greater than 250.

[Item 12]

The golf ball according to Item 10 or 11, wherein a difference (β1−β2) between the angles β1 and β2 is not less than 5°.

[Item 13]

The golf ball according to any one of Items 8 to 12, wherein a central angle θ1 between front and back ends of the first guide mark is not less than 90°, and a central angle θ2 between front and back ends of the second guide mark is not less than 90°.

[Item 14]

The golf ball according to any one of Items 8 to 13, wherein the first guide mark is directional, and the second guide mark is directional.

[Item 15]

The golf ball according to any one of Items 8 to 14, wherein the first guide mark extends along a great circle of a sphere of the golf ball, and the second guide mark extends along another great circle of the sphere.

[Item 16]

The golf ball according to any one of Items 8 to 15, further including an assist mark indicating an attitude to be assumed by the golf ball when the golf ball is set by the player.

The golf ball is suitable for, for example, playing golf on golf courses and practicing at driving ranges. The foregoing description is given for illustrative purposes only, and various modifications can be made without departing from the principles of the disclosed embodiments.

What is claimed is:

1. A golf ball comprising a guide mark, wherein the guide mark is shaped such that the guide mark is distorted in plan and that when a player hits the golf ball with a golf club, the guide mark is perceived by the player to be undistorted in a sight line view of the player, and wherein a central angle β of the guide mark with respect to a vertical direction is not less than 5° and not greater than 40°.

2. The golf ball according to claim 1, wherein the guide mark is shaped such that the guide mark is curved in plan and straight in the sight line view.

3. The golf ball according to claim 1, wherein a central angle θ between front and back ends of the guide mark is not less than 90°.

4. The golf ball according to claim 1, wherein the guide mark is directional.

5. The golf ball according to claim 1, wherein the guide mark extends along a great circle of a sphere of the golf ball.

6. The golf ball according to claim 1, further comprising an assist mark indicating an attitude to be assumed by the golf ball when the golf ball is set by the player.

7. The golf ball according to claim 6, wherein a central angle β of the guide mark with respect to a vertical direction is not less than 5° and not greater than 40°, when the assist mark is located at the north pole.

8. A golf ball comprising a first guide mark and a second guide mark, wherein the first guide mark is shaped such that the first guide mark is distorted in plan and that when the player hits the golf ball with a first golf club, the first guide mark is perceived by the player to be undistorted in a first sight line view of the player, and the second guide mark is shaped such that the second guide mark is distorted in plan and that when the player hits the golf ball with a second golf club, the second guide mark is perceived by the player to be undistorted in a second sight line view of the player, wherein a central angle β1 of the first guide mark with respect to a vertical direction is not less than 5° and not greater than 40°, wherein a central angle β2 of the second guide mark with respect to the vertical direction is not less than 5° and not greater than 40°, and wherein the angle β1 is greater than the angle β2.

9. The golf ball according to claim 8, wherein the first guide mark is shaped such that the first guide mark is curved in plan and straight in the first sight line view, and the second guide mark is shaped such that the second guide mark is curved in plan and straight in the second sight line view.

10. The golf ball according to claim 8, wherein the angle β1 is not less than 20° and not greater than 35°, and the angle β2 is not less than 10° and not greater than 25°.

11. The golf ball according to claim 8, wherein a difference (β1−β2) between the angles β1 and β2 is not less than 5°.

12. The golf ball according to claim 8, wherein a central angle θ1 between front and back ends of the first guide mark is not less than 90°, and a central angle θ2 between front and back ends of the second guide mark is not less than 90°.

13. The golf ball according to claim 8, wherein the first guide mark is directional, and the second guide mark is directional.

14. The golf ball according to claim 8, wherein the first guide mark extends along a great circle of a sphere of the golf ball, and the second guide mark extends along another great circle of the sphere.

15. The golf ball according to claim 8, further comprising an assist mark indicating an attitude to be assumed by the golf ball when the golf ball is set by the player.

16. The golf ball according to claim 15, wherein a central angle β1 of the first guide mark with respect to a vertical direction is not less than 5° and not greater than 40°, and a central angle β2 of the second guide mark with respect to the vertical direction is not less than 5° and not greater than 40°, when the assist mark is located at the north pole.

* * * * *